US008831870B2

(12) United States Patent
Whikehart et al.

(10) Patent No.: US 8,831,870 B2
(45) Date of Patent: Sep. 9, 2014

(54) VEHICLE COLLISION AVOIDANCE AND MITIGATION SYSTEM

(75) Inventors: J William Whikehart, Milford, MI (US); Debra A Bezzina, Livonia, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 220 days.

(21) Appl. No.: 13/286,419

(22) Filed: Nov. 1, 2011

(65) Prior Publication Data

US 2013/0110309 A1 May 2, 2013

(51) Int. Cl.
*G08G 1/16* (2006.01)

(52) U.S. Cl.
CPC ..... *G08G 1/162* (2013.01); *G08G 1/166* (2013.01)
USPC ..... 701/301

(58) Field of Classification Search
CPC ..... G01S 2013/936; G08G 1/161
USPC ..... 701/301
See application file for complete search history.

(56) References Cited

U.S. PATENT DOCUMENTS

| | | | | |
|---|---|---|---|---|
| 6,026,347 | A * | 2/2000 | Schuster | 701/301 |
| 6,037,860 | A | 3/2000 | Zander et al. | |
| 6,420,996 | B1 * | 7/2002 | Stopczynski et al. | 342/70 |
| 6,480,102 | B1 * | 11/2002 | Miller et al. | 342/70 |
| 6,510,388 | B1 * | 1/2003 | Sporrong et al. | 701/301 |
| 6,516,258 | B1 * | 2/2003 | Herrmann | 701/45 |
| 6,625,540 | B2 | 9/2003 | Kageyama | |
| 6,658,336 | B2 * | 12/2003 | Browne et al. | 701/45 |
| 6,791,471 | B2 * | 9/2004 | Wehner et al. | 340/903 |
| 6,859,705 | B2 * | 2/2005 | Rao et al. | 701/45 |
| 7,444,240 | B2 | 10/2008 | Macneille et al. | |
| 7,516,014 | B2 * | 4/2009 | Hammarlund et al. | 701/301 |
| 7,523,000 | B2 | 4/2009 | Tengler et al. | |
| 7,565,234 | B2 | 7/2009 | Noda et al. | |

(Continued)

FOREIGN PATENT DOCUMENTS

| | | | | |
|---|---|---|---|---|
| DE | 10334203 | A1 * | 3/2005 | G08G 1/16 |
| EP | 1889765 | A1 | 2/2008 | |

(Continued)

OTHER PUBLICATIONS

EPO machine translation of WO 2007/009583 (original WO document published Jan. 25, 2007).*

(Continued)

*Primary Examiner* — Behrang Badii
*Assistant Examiner* — David Testardi
(74) *Attorney, Agent, or Firm* — Klintworth & Rozenblat IP LLC

(57) ABSTRACT

A system which jointly reduces damage from an impending collision between multiple vehicles includes sensing devices, at least one processor, at least one memory, output devices, and communication devices. The sensing devices sense conditions near, around, in, or involving multiple vehicles. The at least one memory is in electronic communication with the at least one processor, and includes programming code for execution by the at least one processor. The programming code is configured to analyze the sensed conditions sensed by the sensing devices to jointly determine and output instructions to multiple vehicles for jointly reducing damage from an impending collision between them. The output devices output or implement the jointly determined output instructions to multiple vehicles. The communication devices communicate the sensed conditions from the sensing devices to the at least one processor, and communicate the jointly determined output instructions from the at least one processor to the output devices.

24 Claims, 2 Drawing Sheets

(56) References Cited

U.S. PATENT DOCUMENTS

| | | | | |
|---|---|---|---|---|
| 8,154,422 | B2 * | 4/2012 | Hsu et al. | 340/903 |
| 8,466,807 | B2 * | 6/2013 | Mudalige | 340/903 |
| 8,489,317 | B2 * | 7/2013 | Caveney et al. | 701/301 |
| 2003/0006889 | A1 * | 1/2003 | Koike | 340/435 |
| 2003/0139881 | A1 * | 7/2003 | Miller et al. | 701/301 |
| 2003/0186675 | A1 | 10/2003 | Davis et al. | |
| 2006/0106538 | A1 * | 5/2006 | Browne et al. | 701/301 |
| 2007/0016372 | A1 | 1/2007 | Browne et al. | |
| 2007/0021915 | A1 | 1/2007 | Breed et al. | |
| 2007/0233353 | A1 | 10/2007 | Kade | |
| 2008/0046145 | A1 | 2/2008 | Weaver et al. | |
| 2009/0018740 | A1 | 1/2009 | Noda et al. | |
| 2009/0070026 | A1 * | 3/2009 | Kubota | 701/117 |
| 2010/0057361 | A1 * | 3/2010 | Caveney et al. | 701/301 |
| 2010/0070148 | A1 | 3/2010 | Solyom et al. | |
| 2011/0071761 | A1 | 3/2011 | Cummings | |
| 2011/0106442 | A1 | 5/2011 | Desai et al. | |

FOREIGN PATENT DOCUMENTS

| | | | | | |
|---|---|---|---|---|---|
| JP | 2007147390 | A | | 6/2007 | |
| JP | 2007189436 | A | * | 7/2007 | |
| JP | 2008181200 | A | * | 8/2008 | |
| JP | 2009-501655 | A | | 1/2009 | |
| JP | 2010003237 | A | | 1/2010 | |
| WO | WO 2007009583 | A1 | * | 1/2007 | G07C 5/00 |

OTHER PUBLICATIONS

Amy Gilroy—"Ford Prototype Car Talks to Other Cars", filed under Car 3, Car News, Home Page Featured, Industry News, CE Outlook.com web page, (Article dated Jan. 26, 2011).

English translation of Japanese Office Action dated Oct. 30, 2013.

English machine translation of JP2009-501655, (original JP document published Jan. 22, 2009).

* cited by examiner

VEHICLE COLLISION AVOIDANCE AND MITIGATION SYSTEM

FIELD OF THE DISCLOSURE

The disclosure relates to systems and methods for jointly reducing damage from an impending collision between multiple vehicles.

BACKGROUND OF THE DISCLOSURE

Some systems exist in which a vehicle uses sensors in communication with a processor to determine a collision avoidance plan to reduce the likelihood of a collision of the vehicle with other vehicles, structures around the vehicle, or pedestrians. These systems may only use the sensor data from the vehicle itself without gathering other sensor data such as sensor data from other vehicles. These systems may also only determine a collision avoidance plan for the vehicle itself without jointly determining a joint collision avoidance plan for all vehicles which may be involved in the collision. Other systems may jointly determine a joint collision avoidance plan for all vehicles which may be involved in the collision, in an effort to avoid the collision all-together, but may not determine a joint collision damage reduction plan for all vehicles which will reduce damage actually resulting from the occurrence of a collision.

A system and method is needed to reduce or resolve one or more issues of one or more of the existing systems.

SUMMARY OF THE DISCLOSURE

In one embodiment, a system is disclosed for jointly reducing damage from an impending collision between multiple vehicles. The system comprises sensing devices, at least one processor, at least one memory, output devices, and communication devices. The sensing devices are for sensing conditions near, around, in, or involving multiple vehicles. The at least one memory is in electronic communication with the at least one processor. The at least one memory comprises programming code for execution by the at least one processor. The programming code is configured to analyze the sensed conditions sensed by the sensing devices to jointly determine and output instructions to multiple vehicles for jointly reducing damage from an impending collision between them. The output devices are for outputting or implementing the jointly determined output instructions to multiple vehicles. The communication devices are for communicating the sensed conditions from the sensing devices to the at least one processor, and for communicating the jointly determined output instructions from the at least one processor to the output devices.

In another embodiment, a method is disclosed for jointly reducing damage from an impending collision between multiple vehicles. In one step, conditions are sensed near, around, in, or involving multiple vehicles using sensing devices. In another step, the sensed conditions are communicated from the sensing devices to at least one processor using at least one communication device. In an additional step, the sensed conditions communicated from the sensing devices to the at least one processor are analyzed, using programming code stored in at least one memory and executed by the at least one processor, to jointly determine output instructions for the multiple vehicles to jointly reduce damage from an impending collision between them. In yet another step, the jointly determined output instructions are communicated, using the at least one communication device or at least another communication device, from the at least one processor to output devices of the multiple vehicles. In another step, the communicated jointly determined output instructions are outputted, using the output devices of the multiple vehicles, to jointly reduce damage from an impending collision between them.

These and other features, aspects and advantages of the disclosure will become better understood with reference to the following drawings, description and claims.

DETAILED DESCRIPTION OF THE DISCLOSURE

The following detailed description is of the best currently contemplated modes of carrying out the disclosure. The description is not to be taken in a limiting sense, but is made merely for the purpose of illustrating the general principles of the disclosure, since the scope of the disclosure is best defined by the appended claims. It is noted that the Figures are purely for illustrative purposes and are not to scale.

Figure 1:
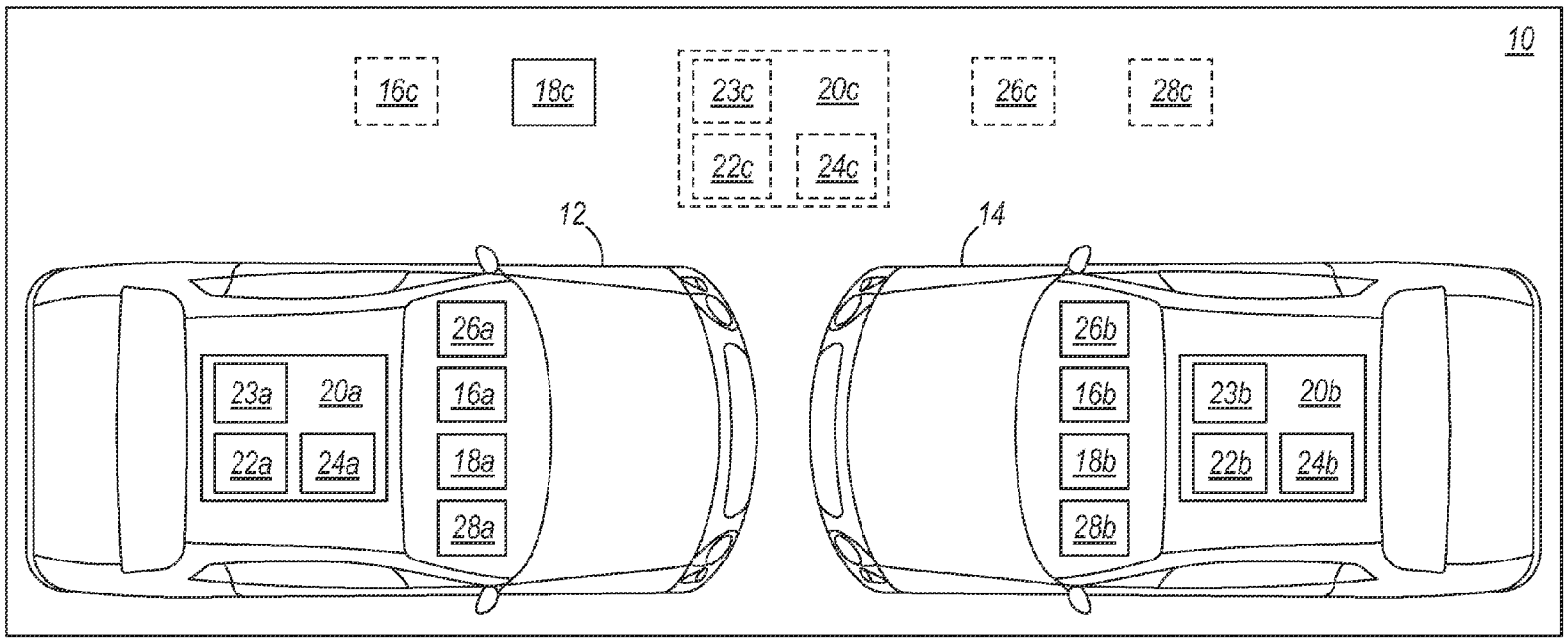
FIG. 1 illustrates a box diagram of a system for jointly reducing damage from an impending collision between multiple vehicles.

FIG. 1 illustrates a box diagram of a system 10 for jointly reducing damage from an impending collision between multiple vehicles 12 and 14. Although the vehicles 12 and 14 may still collide, the system 10 will jointly reduce the damage resulting from the collision. The vehicles 12 and 14 may comprise any type of vehicles for transporting people or animals such as cars, busses, or other types of vehicles. The system 10 may jointly reduce damage from the impending collision to the multiple vehicles 12 and 14, to occupants in the multiple vehicles 12 and 14, or to people, animals, buildings, or other structures located in the vicinity of the multiple vehicles 12 and 14.

The system 10 comprises vehicles 12 and 14, sensing devices 16*a* and 16*b*, processors 20*a* and 20*b* in communication with memories 22*a* and 22*b* and databases 23*a* and 23*b*, output devices 26*a* and 26*b*, and communication devices 28*a* and 28*b*. The sensing devices 16*a* and 16*b* are for sensing conditions 18*a*, 18*b*, or 18*c* near, around, in, or involving the multiple vehicles 12 and 14. Sensing device 16*a* comprises a portion of vehicle 12. Sensing device 16*b* comprises a portion of vehicle 14. Optionally, sensing device 16*c* may be located outside of vehicles 12 and 14. The sensing devices 16*a* and 16*b* and optional sensing device 16*c* comprise at least one of a camera, a laser device, a radar device, or another type of sensing device for sensing conditions 18*a*, 18*b*, or 18*c* near, around, in, or involving the multiple vehicles 12 and 14. The condition 18*a* is a condition in or of vehicle 12. The condition 18*b* is a condition in or of vehicle 14. The condition 18*c* is a condition of the environment outside of vehicles 12 and 14.

The conditions 18*a*, 18*b*, or 18 sensed by the sensing devices 16*a* and 16*b*, or optional sensing device 16*c*, comprise at least one of a weather condition, a pavement condition, vehicle positions, vehicle speeds, vehicle directions, vehicle accelerations, vehicle decelerations, a traffic light condition, a structure location, a building location, a person location, an obstacle location, vehicle occupant locations, vehicle air bag information, or vehicle seat-belt information.

Processor 20*a* is located in or on vehicle 12 and is in electronic communication with memory 22*a*, memory 22*b*, or optional memory 22*c*, and with database 23*a*, database 23*b*, or with optional database 23*c*. Memory 22*a* comprises programming code, for execution by processor 20*a*, which is configured to analyze the sensed conditions 18*a*, 18*b*, or 18*c* sensed by sensing devices 16, 16*b*, or optional sensing device 16*c*, and the data in databases 23*a* and 23*b*, or optional database 23*c*, to jointly determine and output instructions 24*a*, 24*b*, or optional instructions 24*c*, to vehicles 12 and 14 for jointly reducing damage from an impending collision between them.

The data in databases 23*a*, 23*b*, or in optional database 23*c* may comprise at least one of vehicle handling capabilities, vehicle crash testing data, vehicle impact data as to where ideal locations are for vehicle impact, vehicle frame structure information, vehicle energy absorption information, or other types of data Processor 20*b* is located in or on vehicle 14 and is in electronic communication with memory 22*a*, memory 22*b*, or optional memory 22*c* and with database 23*a*, database 23*b*, or with optional database 23*c*. Memory 22*b* comprises programming code, for execution by processor 20*b*, which is configured to analyze the sensed conditions 18*a*, 18*b*, or 18*c* sensed by sensing devices 16, 16*b*, or optional sensing device 16*c*, and the data in databases 23*a* and 23*b*, or optional database 23*c*, to jointly determine and output instructions 24*a*, 24*b*, or optional instructions 24*c*, to vehicles 12 and 14 for jointly reducing damage from an impending collision between them.

Optional processor 20*c* may be located outside of or apart from vehicles 12 and 14 and may be in electronic communication with memory 22*a*, memory 22*b*, or optional memory 22*c* and with database 23*a*, database 23*b*, or optional database 23*c*. Optional memory 22*c* comprises programming code, for execution by optional processor 20*c*, which is configured to analyze the sensed conditions 18*a*, 18*b*, or 18*c* sensed by sensing devices 16, 16*b*, or optional sensing device 16*c*, and the data in databases 23*a* and 23*b*, or optional database 23*c*, to jointly determine and output instructions 24*a*, 24*b*, or optional instructions 24*c*, to vehicles 12 and 14 for jointly reducing damage from an impending collision between them.

The processors 20*a*, 20*b*, or optional processor 20*c*, may communicate with one another, the memories 22*a*, 22*b*, or optional memory 22*c*, and the databases 23*a*, 23*b*, or optional database 23*c*, and act jointly together in concert to jointly determine and output the instructions 24*a*, 24*b*, or optional instructions 24*c*, to vehicles 12 and 14 for jointly reducing damage from an impending collision between them. In other embodiments, any number of the processors 20*a*, 20*b*, or optional processor 20*c* may determine and output the instructions 24*a*, 24*b*, or optional instructions 24*c* to vehicles 12 and 14 to jointly reduce damage to vehicles 12 and 14 from an impending collision between them.

The jointly determined output instructions 24*a*, 24*b*, or optional instructions 24*c*, may comprise at least one of vehicle steering control instructions, vehicle speed control instructions, vehicle braking instructions, vehicle sound instructions, vehicle light instructions, vehicle audio instructions, vehicle display instructions, vehicle air bag instructions, vehicle seat belt instructions, vehicle energy absorption instructions, traffic light instructions, instructions for an external vehicle output device, or instructions for another type of output device.

Output devices 26*a*, 26*b*, or optional output device 26*c* are for outputting or implementing the jointly determined output instructions 24*a*, 24*b*, or optional output instructions 24*c*, to vehicles 12 and 14. Output devices 26*a*, 26*b*, or optional output device 26*c*, comprise at least one of vehicle steering control devices, vehicle speed control devices, vehicle braking devices, vehicle sound devices, vehicle light devices, vehicle audio devices, vehicle display devices, vehicle air bag devices, vehicle seat belt devices, vehicle energy absorption devices, a traffic light device, an external vehicle output device, or another type of output device. Output device 26*a* comprises a portion of vehicle 12. Output device 26*b* comprises a portion of vehicle 14. Optional output device 26*c* may be located outside of vehicles 12 and 14 for outputting or implementing the jointly determined output instructions 24*a*, 24*b*, or optional instructions 24*c*, to people or devices located outside of vehicles 12 and 14. For instance, the optional output device 26*c* may comprise a traffic light device, an external vehicle output device, or another type of output device.

Communication devices 28*a* and 28*b*, or optional communication device 28*c*, are for communicating the sensed conditions 18*a*, 18*b*, or 18*c* from the sensing devices 16, 16*b*, or optional sensing device 16*c*, to the processors 20*a*, 20*b*, or optional processor 20*c*. Communication devices 28*a* and 28*b*, or optional communication device 28*c*, are also for communicating the jointly determined output instructions 24*a* and 24*b*, or optional output instructions 24*c*, from the processors 20*a* and 20*b*, or optional processor 20*c*, to the output devices 26*a* and 26*b*, or optional output device 26*c*. Communication devices 28*a*, 28*b*, or optional communication device 28*c*, may comprise a wireless communication device, a satellite, the internet, or another type of communication device. Communication device 28*a* comprises a portion of vehicle 12. Communication device 28*b* comprises a portion of vehicle 14. Optional communication device 28*c* may be located outside of vehicles 12 and 14.

In other embodiments, the system 10, including all of the system's components, may vary in quantity, size, configuration, orientation, actual components, or function.

Figure 2:
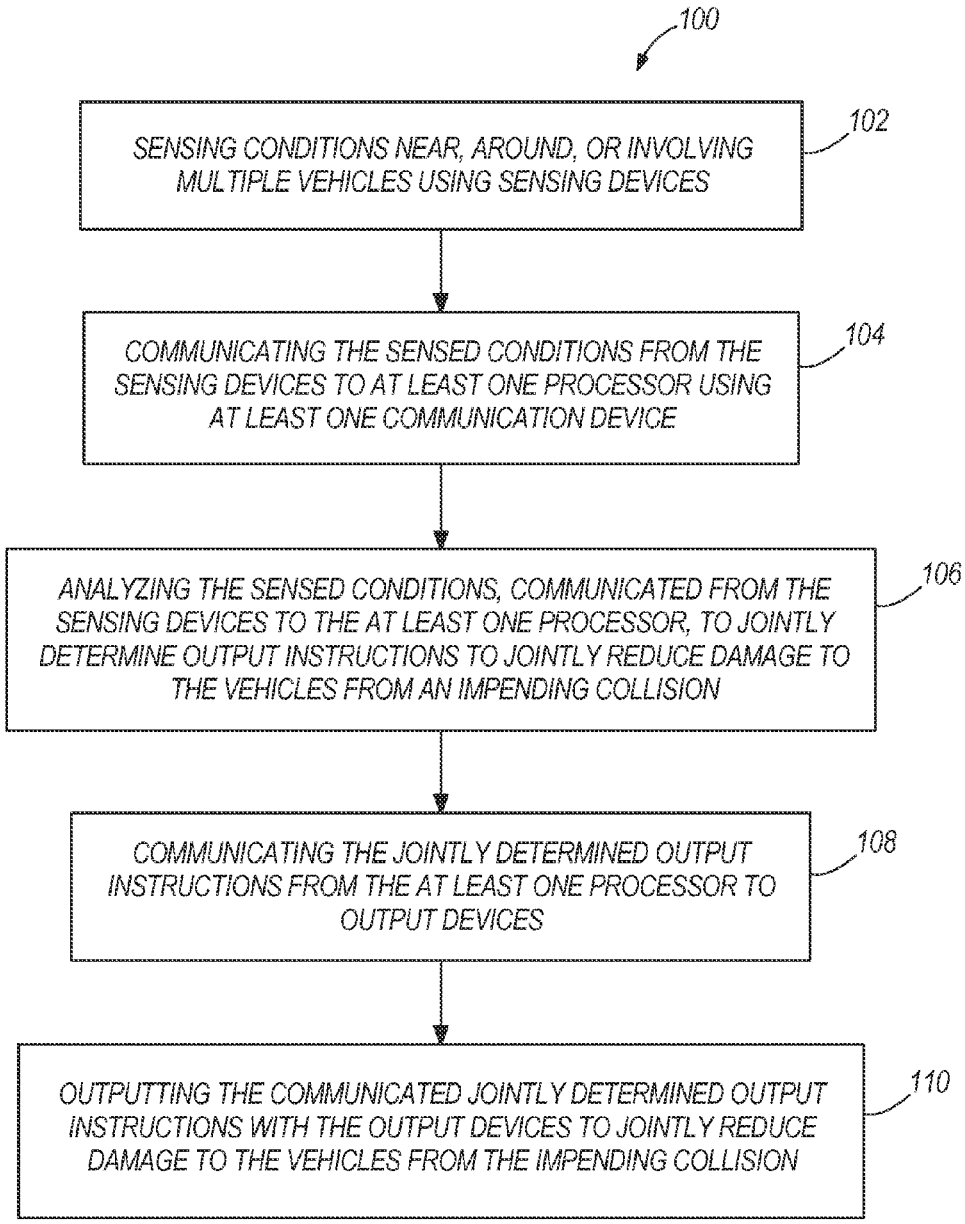
FIG. 2 illustrates is a flowchart illustrating one embodiment of a method for jointly reducing damage from an impending collision between multiple vehicles.

FIG. 2 is a flowchart illustrating one embodiment of a method 100 for jointly reducing damage from an impending collision between multiple vehicles. In step 102, conditions near, around, or involving multiple vehicles is sensed using sensing devices. In one embodiment, the sensing devices comprise at least one of a camera device, a laser device, or a radar device. In another embodiment, the conditions sensed by the sensing devices comprise at least one of a weather condition, a pavement condition, vehicle positions, vehicle speeds, vehicle directions, vehicle accelerations, vehicle decelerations, a traffic light condition, a structure location, a building location, a person location, an obstacle location, vehicle occupant locations, vehicle air bag information, or vehicle seat-belt information.

In step 104, the sensed conditions are communicated from the sensing devices to at least one processor using at least one communication device. In one embodiment, the at least one communication device comprises at least one of a wireless communication device, a satellite, or an internet. In step 106, the sensed conditions communicated from the sensing devices to the at least one processor are analyzed, using programming code stored in at least one memory and executed by the at least one processor, to jointly determine output instructions for the multiple vehicles to jointly reduce damage from an impending collision between them.

In one embodiment, step 106 may further comprise analyzing data stored in at least one database, in communication with the at least one processor, using the programming code stored in the at least one memory and executed by the at least one processor, to jointly determine the output instructions for the multiple vehicles to jointly reduce the damage from the impending collision between them. The data stored in the at least one database may comprise at least one of vehicle handling capabilities, vehicle crash testing data, vehicle impact data as to where ideal locations are for vehicle impact, vehicle frame structure information, vehicle energy absorption information, or other types of data. In another embodiment, the jointly determined output instructions may comprise at least one of vehicle steering control instructions, vehicle speed control instructions, vehicle braking instructions, vehicle sound instructions, vehicle light instructions, vehicle audio instructions, vehicle display instructions, vehicle air bag instructions, vehicle seat belt instructions, vehicle energy absorption instructions, traffic light instructions, instructions for an external vehicle output device, or instructions for another type of output device.

In step 108, the jointly determined output instructions are communicated, using the at least one communication device or at least another communication device, from the at least one processor to output devices. In one embodiment, the communication devices comprise at least one of wireless communication devices, a satellite, or an internet. The output devices may comprise portions of the multiple vehicles or may be disposed outside of the vehicles. In one embodiment, the output devices comprise at least one of vehicle steering control devices, vehicle speed control devices, vehicle braking devices, vehicle sound devices, vehicle light devices, vehicle audio devices, vehicle display devices, vehicle air bag devices, vehicle seat belt devices, vehicle energy absorption devices, a traffic light device, or an external vehicle output device. In step 110, the communicated jointly determined output instructions are outputted, using the output devices, to jointly reduce damage to the vehicles from an impending collision between the vehicles.

In one embodiment, the multiple vehicles comprise the sensing devices, the output devices, the communication devices, and the at least one processor. In another embodiment, the at least one processor comprises separate processors of each of the multiple vehicles communicating with one another and acting jointly to jointly determine the output instructions for jointly reducing damage from the impending collision between the vehicles. In still another embodiment, each of the multiple vehicles comprises at least one of the sensing devices, at least one of the output devices, at least one of the communication devices, and at least one of the at least one processor. In an additional embodiment, the multiple vehicles comprise the sensing devices, the output devices, and the communication devices, and one or more of the at least one processor is located apart from the vehicles.

One or more embodiments of the disclosure may reduce one or more issues of one or more of the existing systems by jointly determining a joint plan for multiple vehicles to reduce damage from an impending collision between them. These embodiments may rely on sensor data from multiple vehicles to determine the joint plan. Further, these embodiments may jointly determine a joint plan for multiple vehicles to jointly reduce the damage which results to the vehicles from an actual collision between them. In still other embodiments, one or more additional issues of the existing art may be reduced or resolved.

It should be understood, of course, that the foregoing relates to exemplary embodiments of the disclosure and that modifications may be made without departing from the spirit and scope of the disclosure as set forth in the following claims.

We claim:

1. A system for reducing damage from an impending collision between multiple vehicles comprising:

sensing devices for sensing conditions near, around, in, or involving multiple vehicles;

at least one processor;

at least one database in electronic communication with the at least one processor;

at least one memory in electronic communication with the at least one processor, wherein the at least one memory comprises programming code for execution by the at least one processor, and the programming code is configured to analyze the sensed conditions sensed by the sensing devices and to analyze data contained in the at least one database to determine and output instructions to the multiple vehicles to reduce damage from an impending collision between them, wherein the data to be analyzed by the programming code which is contained in the at least one database comprises vehicle handling capabilities and vehicle impact data as to where ideal locations are for vehicle impact;

output devices for outputting or implementing the determined output instructions to the multiple vehicles in order to reduce the damage from the impending collision between the multiple vehicles; and at least one communication device for communicating the sensed conditions from the sensing devices to the at least one processor and for communicating the determined output instructions from the at least one processor to the output devices.

2. The system of claim 1 wherein the multiple vehicles comprise the sensing devices, the output devices, the at least one communication device, and the at least one processor.

3. The system of claim 2 wherein the at least one processor comprises separate processors of each of the multiple vehicles communicating with one another and acting together to determine and output the instructions to the multiple vehicles to reduce the damage from the impending collision between them.

4. The system of claim 2 wherein each of the multiple vehicles comprises at least one of the sensing devices, at least one of the output devices, at least one of the communication device, and at least one of the at least one processor.

5. The system of claim 1 wherein the sensing devices comprise at least one of a camera device, a laser device, or a radar device.

6. The system of claim 1 wherein the conditions sensed by the sensing devices comprise a traffic light condition.

7. The system of claim 1 wherein the conditions sensed by the sensing devices comprise a building location.

8. The system of claim 1 wherein the conditions sensed by the sensing devices comprise a person location.

9. The system of claim 1 wherein the conditions sensed by the sensing devices comprise a vehicle occupant location.

10. The system of claim 1 wherein the conditions sensed by the sensing devices comprise vehicle air bag information.

11. The system of claim 1 wherein the conditions sensed by the sensing devices comprise vehicle seat-belt information.

12. The system of claim 1 wherein the determined output instructions comprise traffic light instructions.

13. The system of claim 1 wherein the at least one output device comprises a traffic light device.

14. The system of claim 1 wherein the at least one communication device comprises an internet.

15. The system of claim 1 wherein the data contained in the at least one database comprises the vehicle handling capabilities for each of the multiple vehicles, and the vehicle impact data as to where the ideal locations are for the vehicle impact in each of the multiple vehicles.

16. A method for reducing damage from an impending collision between multiple vehicles comprising:

sensing conditions near, around, in, or involving multiple vehicles using sensing devices;

communicating the sensed conditions from the sensing devices to at least one processor using at least one communication device;

analyzing the sensed conditions communicated from the sensing devices to the at least one processor in conjunction with analyzing data contained in at least one database, the analyzed data comprising vehicle handling capabilities and vehicle impact data as to where ideal locations are for vehicle impact, using programming code stored in at least one memory and executed by the at least one processor, to determine output instructions for the multiple vehicles to reduce damage from an impending collision between them;

communicating the determined output instructions, using the at least one communication device or at least another communication device, from the at least one processor to output devices of the multiple vehicles; and outputting the communicated determined output instructions, using the output devices of the multiple vehicles, to reduce damage from the impending collision between them.

17. The method of claim 16 wherein the multiple vehicles comprise the sensing devices, the output devices, the communication devices, and the at least one processor.

18. The method of claim 17 wherein the at least one processor comprises separate processors of each of the multiple vehicles communicating with one another and acting together to determine the output instructions to the multiple vehicles to reduce the damage from the impending collision between them.

19. The method of claim 17 wherein each of the multiple vehicles comprises at least one of the sensing devices, at least one of the output devices, at least one of the communication devices, and at least one of the at least one processor.

20. The method of claim 16 wherein the sensing devices comprise at least one of a camera device, a laser device, or a radar device.

21. The method of claim 16 wherein the determined output instructions comprise at least one of traffic light instructions.

22. The method of claim 16 wherein the output devices comprise at least one of a traffic light device.

23. The method of claim 16 wherein the communication devices comprise an internet.

24. The method of claim 16 wherein the conditions comprise at least one of a traffic light condition, a building location, a person location, a vehicle occupant location, vehicle air bag information, or vehicle seat-belt information.

* * * * *